US005160416A

United States Patent [19]

Cawlfield et al.

[11] Patent Number: 5,160,416

[45] Date of Patent: Nov. 3, 1992

[54] PROCESS FOR THE PRODUCTION OF PERCHLORIC ACID

[75] Inventors: David W. Cawlfield; Ronald L. Dotson, both of Cleveland; Budd L. Duncan, Athens; Sudhir K. Mendiratta; Kenneth E. Woodard, Jr., both of Cleveland, all of Tenn.

[73] Assignee: Olin Corporation, Cheshire, Conn.

[21] Appl. No.: 674,825

[22] Filed: Mar. 22, 1991

Related U.S. Application Data

[63] Continuation-in-part of Ser. No. 502,099, Mar. 30, 1990, Pat. No. 5,064,514.

[51] Int. Cl.[5] ..... C25B 1/28; C25B 1/22

[52] U.S. Cl. ..... 204/82; 204/103

[58] Field of Search ..... 204/82, 103, 129; 423/476

[56] References Cited

U.S. PATENT DOCUMENTS

| | | | |
|---|---|---|---|
| 3,056,656 | 10/1962 | Nicolaisen | 423/476 |
| 3,681,213 | 8/1972 | Heit et al. | 204/82 |
| 3,810,969 | 5/1974 | Schlumberger | 423/478 |
| 3,995,016 | 11/1976 | Kittle | 423/500 |
| 4,469,576 | 9/1984 | Akazawa et al. | 204/237 |
| 4,490,231 | 12/1984 | Boulton | 204/263 |
| 4,495,048 | 1/1985 | Murakami et al. | 204/267 |
| 4,734,181 | 3/1988 | Cipriano | 204/257 |
| 4,740,287 | 4/1988 | Cawlfield | 204/256 |
| 4,743,350 | 5/1988 | Cawlfield et al. | 203/255 |
| 4,770,756 | 9/1988 | Cawlfield et al. | 204/263 |

*Primary Examiner*—John Niebling
*Assistant Examiner*—Kathryn Gorgos
*Attorney, Agent, or Firm*—Ralph D'Alessandro

[57] ABSTRACT

An electrolytic filter press membrane cell and a method of operating the cell to produce concentrated perchloric acid are disclosed. The cell employs concentrated hypochlorous acid as the anolyte and operates with a two-stage single oxidation process at high current density.

19 Claims, 3 Drawing Sheets

PROCESS FOR THE PRODUCTION OF PERCHLORIC ACID

BACKGROUND OF THE INVENTION

This application is a continuation-in-part of U.S. patent application Ser. No. 07/502,099, now U.S. Pat. No. 5,064,514, issued Nov. 12, 1991, filed Mar. 30, 1990 and assigned to the assignee of the present inventino.

This invention relates to the production of perchloric acid, $HClO_4$, from hypochlorous acid. More specifically it relates to a single two-step oxidation process that employs a filter press membrane cell to electrolytically, produce chloric acid in a high current density operation and then further oxidizes the chloric acid in the cell to form perchloric acid. Perchloric acid may be used in the formation of high purity ammonium perchlorate or other perchlorate compounds.

Chloric acid is a known compound which has been made in laboratory preparations by the reaction of barium chlorate with sulfuric acid to precipitate barium sulfate and produce a dilute aqueous solution of chloric acid which was concentrated by evaporation of water under partial vacuum. In another method, sodium chlorate is reacted with an acid such as hydrochloric acid or sulfuric acid to Produce an aqueous solution of chloric acid containing sulfate or chloride ions as impurities. In addition, commercial processes for producing chlorine dioxide form chloric acid as an intermediate.

U.S. Pat. No. 3,810,969 issued May 14, 1974 to A. A. Schlumberger teaches a process for producing chloric acid of high purity by passing an aqueous solution containing from 0.2 gram mole to 11 gram moles per liter of an alkali metal chlorate such as sodium chlorate through a selected cationic exchange resin at a temperature from 5° to 40° C. The process produces an aqueous solution containing from 0.2 gram mole to about 4.0 gram moles of $HClO_3$.

Until the present time, chloric acid, however, has not been produced or available commercially because of high manufacturing costs and because of concomitant undesired impurities formed with the chloric acid during its production. A way to efficiently produce chloric acid at substantially reduced costs has been discovered that is commercially feasible without the impurities of prior chloric acid processes. The impurities from prior chloric acid processes include alkali metal ions, chloride ions, calcium ions, chromate ions and sulfate ions.

Perchloric acid has been produced previously by the electrochemical oxidation of chlorates, but at high current densities to avoid oxygen evolution. However, this oxidation had to be followed by other processing, such as ion exchange treatment, to remove chromates and cations such as chromium, sodium, potassium and ammonium, from the perchlorate. These prior processes are energy inefficient and require multiple processing steps to isolate and purify the perchloric acid from the perchlorate salts.

These problems are solved in the process of the present invention by providing a filter Press membrane electrolytic cell that operates at high current density to produce a concentrated, high purity perchloric acid in a two-stage single step oxidation process.

SUMMARY OF THE INVENTION

It is an object of the present invention to provide a process to produce perchloric acid from chlorine or hypochlorous acid.

It is another object of the present invention to provide a process that employs a filter press membrane cell which uses an anolyte fluid that is continuously replenished with concentrated hypochlorous acid.

It is a feature of the present invention that the process is performed in an electrolytic cell that is designed to operate at high current density.

It is another feature of the present invention that the use of an ion-permeable, cation selective membrane in the process prevents the depletion of the raw material in the electrolyte by reducing the hypochlorous acid at the cathode.

It is a further feature of the present invention that the presence of hypochlorous acid in the process helps to reduce the evolution of oxygen and thereby increase the yield of perchloric acid.

It is yet another feature of the present invention that the electrochemical oxidation occurs in a two-stage single step reaction within the same electrolytic cell to produce an intermediate chloric acid product that is consumed in the production of the final perchloric acid product.

It is another feature of the present invention that the process employs a single step oxidation of chlorine or hypochlorous acid.

It is still another feature of the present invention that the unreacted hypochlorous acid and chloric acid can be removed from the product in a concentration step by the addition of hydrochloric acid.

It is a further feature of the present invention that the hypochlorous acid content in the anolyte during continuous stabilized operation is below about 10 percent by weight, preferably below about 5 percent and optimally less than about 2 percent.

It is an advantage of the present invention that the process to produce perchloric acid is energy efficient.

It is another advantage of the present invention that the process is performed in an electrolytic cell that operates at high current density and low cell voltage.

It is yet another advantage of the present invention that hydrogen gas is the major co-product of the process and can be used in other chemical processes or can be burned to provide the heat needed to concentrate the perchloric acid.

These and other objects, features and advantages are provided in the process of the present invention to produce perchloric acid in a high current density filter press membrane electrolytic cell from a hypochlorous acid anolyte by employing a two-stage single step oxidation of the hypochlorous acid to chloric acid and then to perchloric acid.

BRIEF DESCRIPTION OF THE DRAWINGS

The objects, features and advantages of the invention will become apparent upon consideration of the following detailed disclosure of the invention, especially when taken in conjunction with the accompanying drawings wherein.

DETAILED DESCRIPTION OF THE PREFERRED EMBODIMENT

Figure 2:
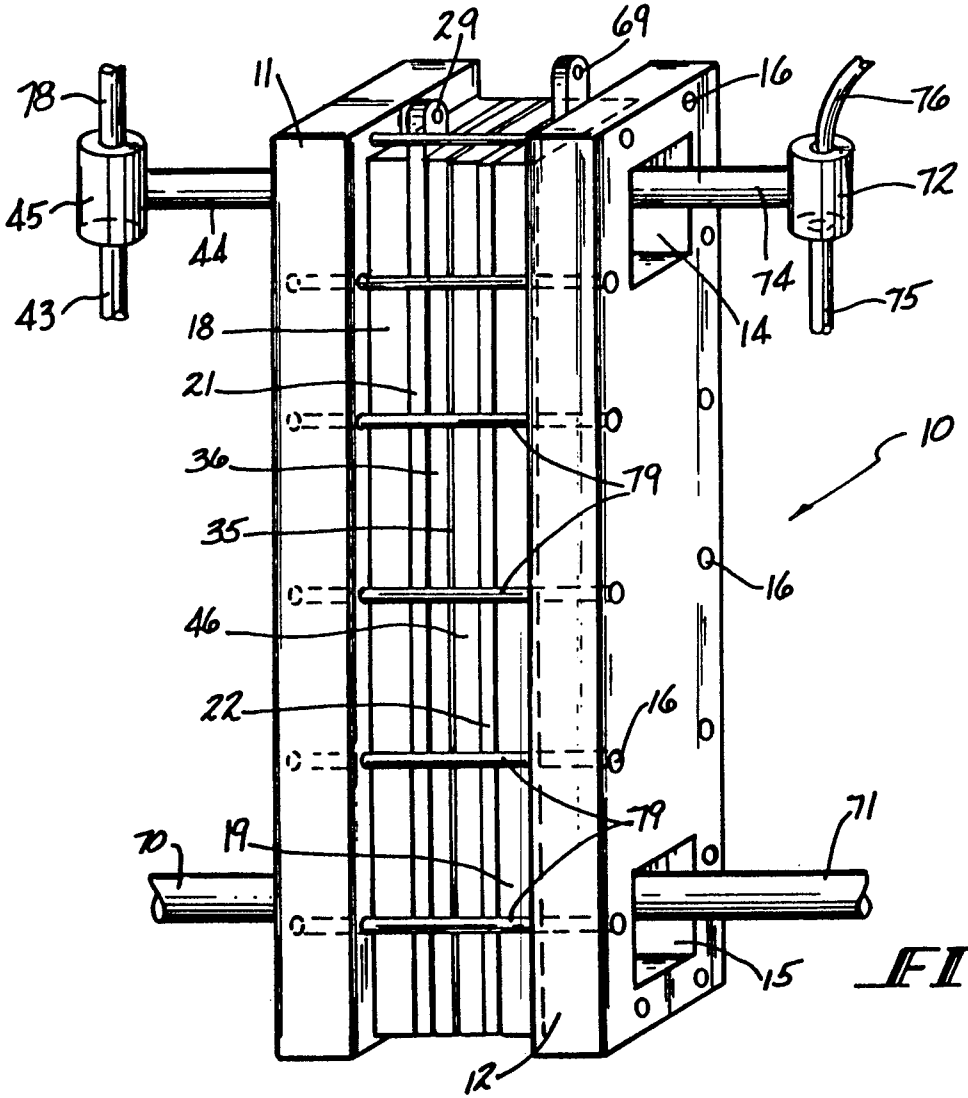
FIG. 2 is a perspective view of the assembled electrolyzer of FIG. 1 showing the anolyte and catholYte disengagers and the anolyte and catholyte feed lines.

An assembled electrolyzer, indicated generally by the numeral 10, as shown in FIG. 2 that is used to produce a chloric acid solution by a process that electrolyzes an aqueous solution of hypochlorous acid at a temperature of from about 1° to about 80° C. according to the equation:

$$HOCl + 2H_2O \rightarrow HClO_3 + 2H_2 + 4e$$

The novel process employed in the electrolyzer of the present invention uses a concentrated solution of hypochlorous acid, HOCl, as the starting material. A satisfactory method of producing high purity concentrated HOCl solutions is by the process described by J. P. Brennan et al in U.S. Pat. No. 4,147,761, which is specifically incorporated by reference hereafter in its entirety. This process produces gaseous mixtures that have high concentrations of hypochlorous acid vapors, chlorine monoxide gas, and controlled amounts of water vapor. This gaseous mixture is then converted to a concentrated hypochlorous acid solution.

The electrolyzer 10 employs a hypochlorous acid solution feed to the anolyte that preferably contains concentrations of about 0.5 to about 60, and more preferably of about 2.0 to about 35 percent by weight of HOCl. The solution is substantially free of ionic impurities, such as chloride ions and alkali metal ions, as well as metal ions, such as nickel and copper. A representative concentration of the chloride ion in the anolyte is less than about 50 parts per million and a representative concentration of an alkali metal ion concentration is less than about 50 parts per million.

The electrochemical process occurs in the electrolyzer or cell 10 of the present invention by using a high conversion rate of HOCl in the cell 10 to reduce the requirements for recycling or purifying residual HOCl. It is theorized that optimum cell efficiency is obtained at a chloric acid concentration of less than about 1 percent by weight and at a perchloric acid concentration of about 20%.

Figure 1:
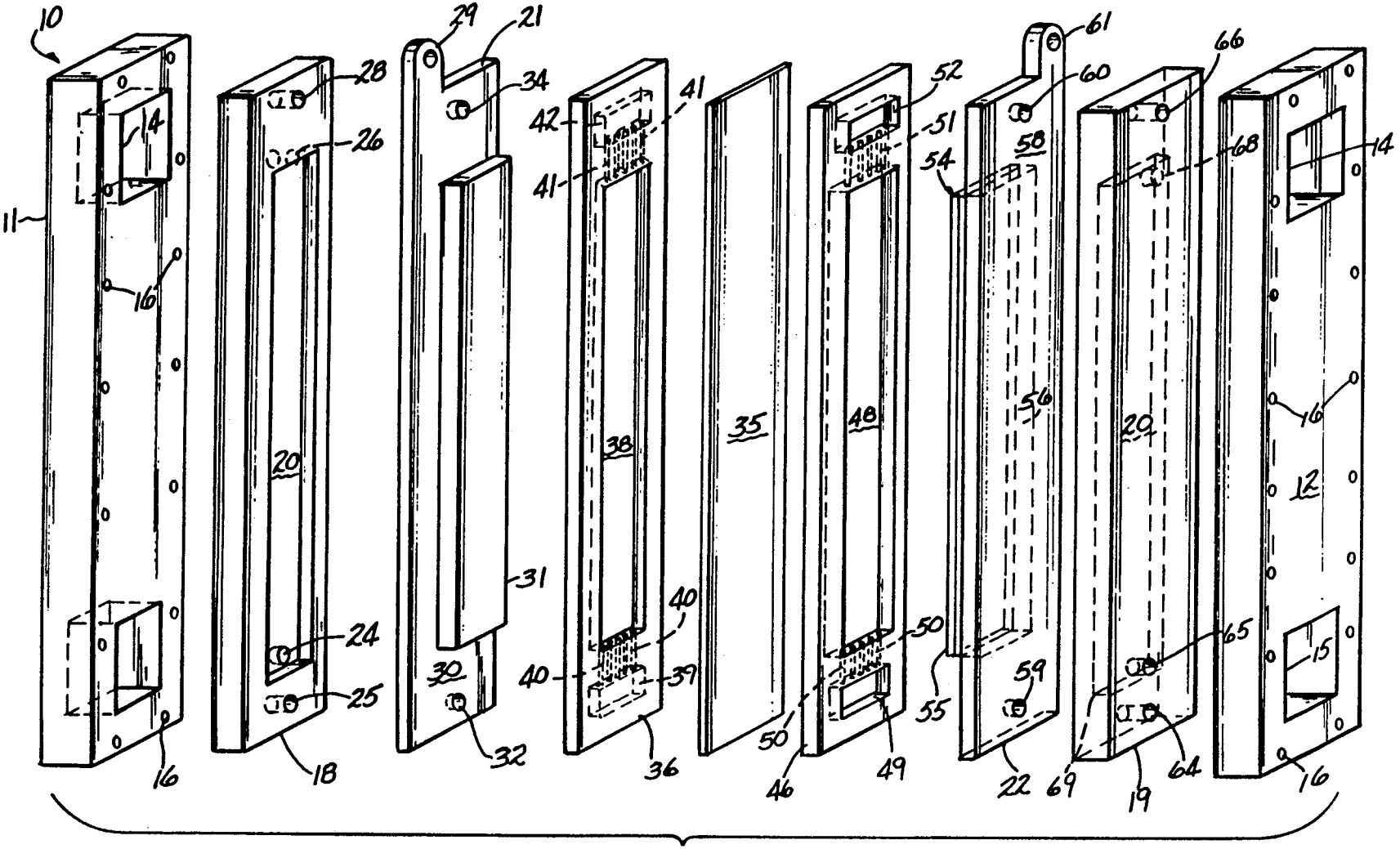
FIG. 1 is an exploded perspective view of the electrolyzer in which the process is performed that has a single anode and a single cathode separated by an ion selectively permeable membrane.

The electrolyzer or cell 10 is shown in exploded fashion in FIG. 1 as comprising on its opposing ends an anode backplate 11 and a cathode backplate 12. Anode backplate 11 and cathode backplate 12 are identical in construction. They are formed from preferably carbon steel that is degreased and are grit or sand blasted. Backplate through passages 14 and 15 are used to permit the anolyte and catholyte infeed pipes and the anolyte and catholyte product outlet pipes to connect into the cell, as can be seen briefly in FIG. 2. A plurality of bolt retaining holes 16 extend about and through the periphery of the backplates 11 and 12 to permit the cell to be assembled and compressed together in a liquid-type fashion by the tightening of the bolts 79 of FIG. 2.

Figures 3, 4, 5, 6, 7, 8:
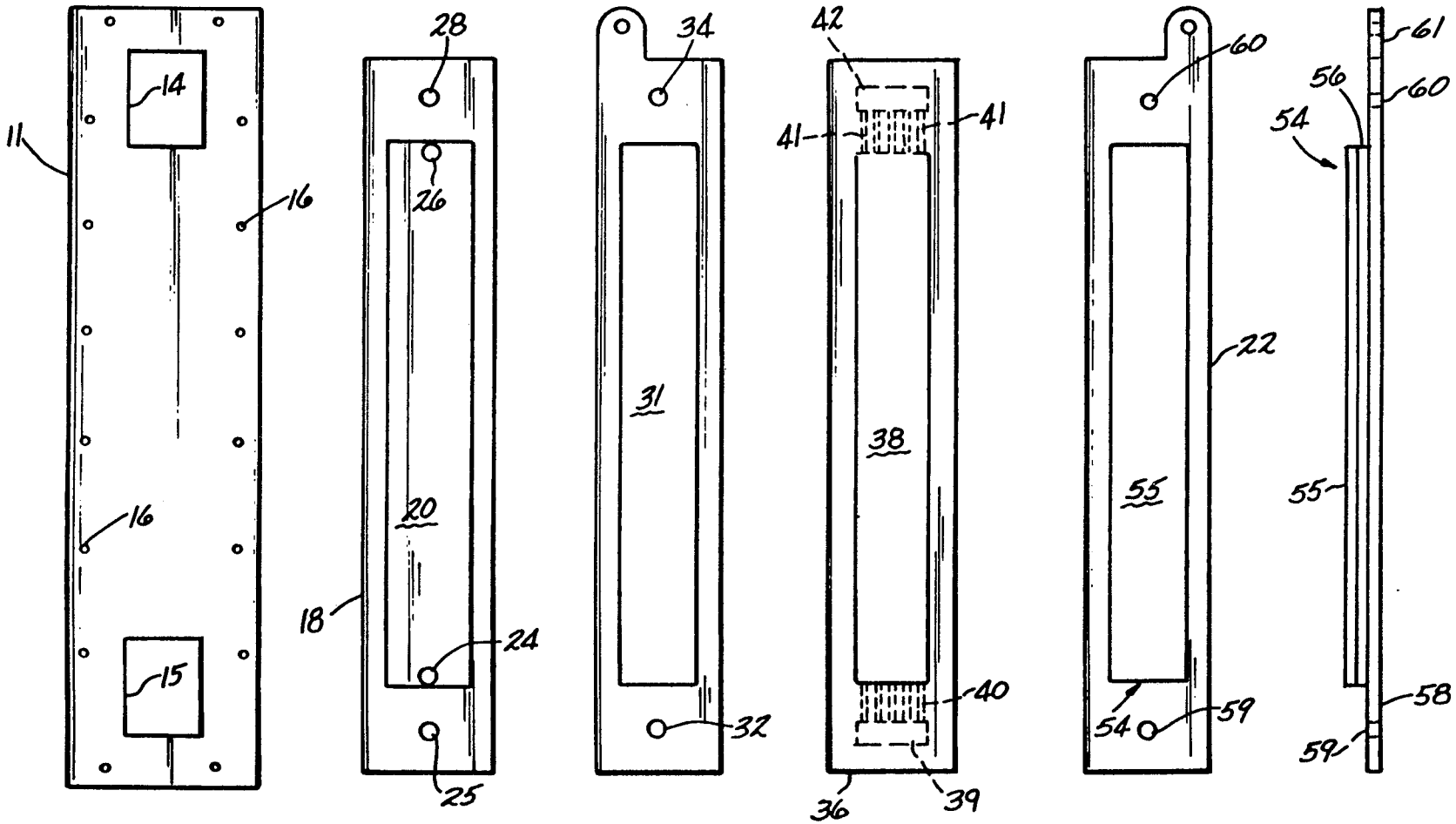
FIG. 3 is a top plan view of the electrolyzer backplate that is used for both the anode and the cathode in the electrolyzer of FIG. 1.
FIG. 4 is a top plan view of the anode cooling plate of the electrolyzer of FIG. 1.
FIG. 5 is a top plan view of the anode of the electrolyzer of FIG. 1.
FIG. 6 is a top plan view of the anode spacer of the electrolyzer of FIG. 1.
FIG. 7 is a top plan view of the cathode of the electrolyzer of FIG. 1.
FIG. 8 is a side elevational view of the cathode of the electrolyzer of FIG. 1.

Adjacent the anode and cathode backplates 11 and 12, respectively, are cell cooling plates 18 and 19. plates 18 and 19 have a hollowed out or grooved area 20 that is open on the side adjacent the anode 21 and the cathode 22 but is closed and solid at the surface of the cooling plate on the side adjacent the backplates 11 and 12. This hollowed out or grooved area 20 will permit the circulation of a coolant to control the heat of the electrolyzer, if necessary. Suitable coolants can include solutions of alcohol or glycol. This may be especially necessary on the anode side to prevent potential thermal decomposition of the hypochlorous acid. As seen in FIGS. 1 and 4, the anode cell cooling plate 18 is designed with a coolant infeec connection 24 and an anolyte infeed connection 25 on its bottom. Near the top, a corresponding coolant outlet connection 26 and an anolyte product outlet connection 28 are provided. The anode cell cooling plate 18 and the cathode cell cooling plate 19 are preferably constructed from a heat and chlorine resistant material. For example, polytetrafluoroethylene such as that sold under the tradename TEFLON®.

The anode 21 is positioned adjacent the anode cooling plate and has a conductive tab 29 at its top to connect to the source of electrical energy to drive the anodic electrolytic reaction. The anode consists of a plate 30, preferably about 0.04 inches thick, to which is suitably fastened a raised mesh or felt portion 31 of the active anode material. An anolyte infeed connection 32, corresponding to the anolyte infeed connection 25 in the anode cell cooling plate 18, is found at the bottom and extends through plate 30. A corresponding anolyte outlet connection 34 is found at the top of plate 30 and corresponds to the anolyte outlet connection 28 in the anode cell cooling plate 18.

The anode structure may utilize titanium in the anode plate 30, or platinum. The active anode surface material 31 can be comprised of any porous high surface area material that has a high oxygen overvoltage, that is stable, and is strongly acidic in an oxidizing environment. Suitable materials that can be employed in the anode structure include platinum and platinum group metals, metal substrates coated with platinum or platinum group metals, lead dioxide and metal substrates coated with lead dioxide and titanium-niobium alloy fibers. Suitable substrates include ceramic or the valve metals, such as titanium and niobium that are electrically conductive and resistant to oxidative acidic conditions. The anode 18 has been made by employing a platinum clad niobium plate 30 to which the active anode surface area material 31 has been spot welded in an inert atmosphere. A titanium felt metal structure, for example, was made by randomly laying titanium fibers on the plate 30 and spot welding them under a helium blanket with an electrical resistance welder. This technique prevents the oxidation of the titanium and allows the titanium to be joined, rather than merely oxidizing and forming non-conductive and non-fusable oxides. A platinum coating may be used on the titanium to form a platinum clad mesh electrode. Titanium-niobium alloy fibers may also be used.

Adjacent the anode 21 and separating the anode 21 from the membrane 35 is an anode spacer 36. Spacer 36 has a hollowed out cavity 38 which is about $\frac{1}{8}$ inch deeper than the active anode surface area material 31 to form an anode chamber that leaves a small gap between the membrane 35 and the active anode surface area material 31 through which the anolyte is circulated in flow parallel to the membrane 35 and through the material of the active anode surface area material 31. Spacer 36 has a flow receptacle 39 that is opened on only the side away from the membrane to receive the inlet flow of anolyte fluid through the connections 25 and 32. The infeed anolyte flows from the receptacle 39 upwardly through inlet passages 40 to the cavity 38 where it comes into contact with the active anode surface area material 31 where it is electrolyzed. The initial chloric acid produced is retained in the cell and further oxidized to form the product perchloric acid. The perchloric acid and any gas, such as hydrogen, and the unreacted anolyte exit the cavity 38 through outlet flow passages 41 and flow into the upper receptacle 42. From there, the product passes out through the anolyte outlet connections 28 and 34 to enter the anolyte outlet conduit 44 of FIG. 2 for separation in the disengager 45 and concentration.

The desired electrochemical oxidation takes place in two stages. First is the oxidation of HOCl to $HClO_3$ with the overall stoichiometry of:

$$2HOCl \rightarrow \tfrac{1}{2}Cl_2 + HClO_3 + 3e^- + 3H^+ \quad (1)$$

and, secondly $$HClO_3 + H_2O \rightarrow HClO_4 + 2e^- + 2H^+ \quad (2)$$

When HOCl concentrations are greater than about 3% and current density is limited to less than 0.1 amps per square centimeter, reaction (1) predominates, and chloric acid is formed. At lower HOCl concentrations and higher current density, for example, with a current, density of about 0.9 amps per square centimeter perchloric acid is predominately formed. These two electrochemical oxidations can occur in the same cell, thus avoiding the need for separate processing steps.

The presence of hypochlorous acid helps to reduce oxygen evolution, which is an undesirable and difficult to avoid side reaction in the production of perchlorates. It is theorized that the hypochlorous acid absorbs on the sides of the electrode on which oxygen evolution would otherwise be catalyzed.

The final product of the electrochemical oxidation of HOCl includes concentrations of less than about 2% by weight each of HOCl and $HClO_3$. These must be removed before a suitable commercial high purity perchloric acid product can be made. Concentrating the perchloric acid, such as by evaporation of water, and adding HCl, allows both HOCl and $HClO_3$ to be removed in a single step by the following reactions:

$$HCl + HOCl \rightarrow Cl_2 + H_2O$$

and $$2HClO_3 + 2HCl \rightarrow Cl_2 + 2ClO_2 + 2H_2O.$$

When these reactions take place during the evaporation of water from the perchloric acid, they continue to completion and the chlorine and chlorine dioxide produced are removed with the water vapor. Both gases may be recovered and used as feeds to the electrochemical cell. This is a simple one-step purification process that is a great advantage over processes of the prior art, where multiple separation steps must be employed.

The membrane 35 seen in FIG. 1 is a cation selectively permeable exchange membrane that is used as a separator between the anode and cathode compartments. The membrane 35 is inert and substantially impervious to the hydrodynamic flow of electrolytes and the passage therethrough of substantially all of the gas products produced in the anode or cathode compartments. The membrane 35 will permit some hydrogen ions to migrate through the membrane as $H_3O^+$ to pull water through the membrane in a desired membrane water transport mechanism. However, it is desired that the membrane should have the characteristics which minimize membrane chlorine transport, as well as preventing chloride ion back-migration that can lead to chlorine evolution in the anolyte. The membrane 35 prevents reduction of hypochlorous acid at the cathode to prevent depletion of the raw material in the electrolyte. The typical fluorocarbon-based, cation permeable membranes commercially available are highly efficient and exclude chloride ion transport.

Cation exchange membranes are well-known to contain fixed anionic groups that permit intrusion and exchange of cations, and exclude anions from an external source. Generally, the resinous membrane or diaphragm has as a matrix, a cross-linked polymer, to which are attached charged radicals such as $—SO_3$ and/or mixtures thereof with $—COOH^-$. The resins which can be used to produce the membranes include, for example, fluorocarbons, vinyl compounds, polyolefins, hydrocarbons, and copolymers thereof. Preferred are cation exchange membranes such as those comprised of fluorocarbon polymers having a plurality of pendant sulfonic acid groups or mixtures of sulfonic acid groups and phosphonic acid groups. The terms "sulfonic acid group" and "phosphonic acid groups" are meant to include derivatives of sulfonic acid, such as sulfonyl fluoride or sulfonyl chloride which may be converted to sulfonic acid groups by processes such as hydrolysis, or derivatives of phosphonic acid groups which may similarly be converted to phosphonic acid groups by processes such as hydrolysis.

Suitable membranes employed have been that sold by the E. I. Dupont de Nemours Company under the tradename NAFION® 117 and perfluoronated sulfonic acid membranes available by the assignee of U.S. Pat. No. 4,470,888.

Continuing with the description of the exploded view in FIG. 1, a cathode spacer 46 is provided adjacent the membrane 35 and is identical in construction to the anode spacer 36. The hollowed out cavity 48 receives the active area of the cathode in the same way as the anode spacer 36 utilized its hollowed cavity 38. A lower receptacle 49 receives the inlet flow of catholyte but is closed on the side facing the membrane 35. The catholyte flows from the cathode spacer lower receptacle 49 through catholyte inlet passages 50 to the hollowed out cavity 48 where the catholyte flows parallel to the cathode active surface material 54 of the cathode 22. The catholyte is removed from the cathode compartment by the rising action of the hydrogen gas generated on the active cathode surface 54 by passing through the catholyte outlet passages 51 in the cathode spacer 46 and entering the cathode spacer upper receptacle 52.

The cathode 22 as seen in FIGS. 1, 7 and 8 comprises a cathode active surface area 54 and a backplate 58 to which the active surface material is suitably fastened, such as by welding. The catholyte enters and leaves the cathode spacer 46 in the cathode 22 in a manner similar to that by which the anolyte flows through the anolyte side of the cell 10, except that deionized water can be used in one preferred mode of operation as the sole liquid to initially fill the catholyte chamber and thereafter need not be added. The cathode backplate 58, which is formed of a suitably resistant stainless steel, such as a Hastelloy ®C material, has a catholyte inlet connection 59 on the bottom and a catholyte outlet connection 60 and on the top. An electrical connection to the source of electrical power is present as tab 61 connecting to the top of the backplate 58 to provide the electrical energy to drive the cathodic electrolytic reaction.

Connected to the backplate 58 are two layers of active cathode material 54. The first is a very fine layer that is smooth and in direct contact with the membrane 35 when the cell is assembled. This is a fine 100 mesh material which is laid on top and spot welded to a course second mesh layer 56 that can be from a 6 to a 10 mesh material that allows gas and liquid to pass therethrough in the X and Y axial directions.

The cathode active surface 54 is in contact with the membrane 35 in the assembled cell to minimize the interference of hydrogen gas produced on the cathode with the ionic conduction of hydrogen ions through the membrane to the cathode. A number of suitable materials that evolve hydrogen gas may be employed in the cathode, such as stainless steel, platinum, and platinum or platinum group metal plated substrates. The cathode in the instant cell 10 serves the purpose of converting hydrogen ions to hydrogen gas using the minimum amount of electrical energy. The design of the cathode 22 permits operation of the electrolyzer 10 without having a forced catholyte circulation loop. The catholyte may be any suitably dilute acid such as a mineral acid, or is preferably initially deionized water that is converted to a dilute hydrochloric acid of about 3 to about 5 percent concentration from reduced HOCl and possibly chlorine gas. The HOCl and/or chlorine enters the cathode compartment by transport through the membrane. The hydrogen generated on the active cathode surface 54 moves through the cathode 22 and carries off excess catholyte. The zero-gap configuration of the active surface 54 of the cathode against the membrane 35 minimizes the electrical resistance or IR drop that occurs in the cell.

Varying the pressure on the anolyte side can control the quantity of water that passes through the membrane. Typically, the pressure drop from the anolyte side to the catholyte side is from about 1 to about 40 pounds per square inch (psi). A pressure drop of 1 psi is sufficient to maintain a concentration of about a 3% to about a 5% HCl in the catholyte. A pressure drop of about 40 psi will increase the amount of water that passes through the membrane to dilute the catholyte to about 1% HCl concentration. Alternately, a greater pressure on the catholyte side by back pressure on the hydrogen gas forces back migration of water through the membrane. No acid passes through the membrane because the membrane selectively precludes the passage therethrough of any chloride ions. The back migration of water through the membrane results in the HCl being concentrated to about 30%.

Returning again to the description of the exploded view of the electrolyzer 10 in FIG. 1, it is seen that a cathode cooling plate 19 may be employed adjacent the cathode 22 and between the cathode backplate 12. Cathode cooling plate 19 has a catholyte infeed connection 64 and a catholyte cooling connection 65 near the bottom of the plate 19. A catholyte outlet connection 66 and a catholyte building outlet connection 68 are employed adjacent the top of the plate 19. A hollowed out area 69 in the catholyte cooling plate 19 is provided for the circulation of appropriate coolant in between the cooling inlet feed 65 and the cooling outlet feed 68.

As best seen in FIG. 2 the assemble,d electrolyzer 10 has an anolyte infeed conduit 70 and a catholyte infeed conduit 71 that pass through the anode backplate 11 and cathode backplate 12 bottom through passages 15 to connect with their respective anolyte and catholyte infeed connections. Similarly, an anolyte outlet conduit 44 and a catholyte outlet conduit 74 connect to the anolyte and catholyte outlet connections through the anode backplate 11 and the cathode backplate 12 through passages 14. The catholyte outlet conduit 74 connects to a catholyte disengager 72 which separates the liquid and the gas and recycles or removes for collection the liquid catholyte through a recirculation loop 75, while the catholyte gas exits a gas outlet pipe 76 that exits through the top of the disengager 72. Similarly, the anolyte disengager has an anolyte recirculation loop 43 that exits through the bottom for the recirculated anolyte or hypochlorous acid while the anolyte gas outlet pipe 78 exits the top of the anolyte disengager 45.

It is to be understood that the elements shown in FIG. 1, except for the backplates 11 and 12 and the cooling plates 18 and 19, are separated and sealed by an appropriate gasketing material (not shown) positioned therebetween to ensure fluid tightness. Suitable elastomeric gasketing material includes peroxide cured EPDM or expanded microporous polytetrafluoroethylene sold under the tradename TEFLON® by the aforementioned E. I. Dupont de Nemours & Company. In order to exemplify the results achieved using the electrolyzer in the process of the present invention, the following examples are provided without any intent to limit the scope of the instant invention to the discussion therein. All parts and percentages are by weight unless otherwise indicated.

EXAMPLE 1

An electrochemical cell of the type shown in FIGS. 1 and 2 was employed having an anode chamber and a cathode chamber separated by a cation exchange membrane. The anode was 5 centimeters by 5 centimeters and was formed from a platinum-clad niobium plate about 0.04" thick having an active surface area formed of a 10 ×10 square weave mesh. The anode was spot-welded under an inert helium blanket to a platinum-clad niobium plate and placed within an anode spacer to form the anode chamber. The anode chamber with the spacer was about ⅛ inch (0.3176 centimeters) wider than the anode, leaving a small gap adjacent the cation exchange membrane through which the anolyte was force circulated. The cathode was formed from a two layer Hastelloy ®C-22 mesh structure having a very fine outer 100 mesh screen layer supported on a coarse inner (6 wires per inch) mesh layer. The cathode was attached to a solid Hastelloy ®C-22 backplate by spot welding and was placed within an cathode spacer to form a cathode chamber. The cathode was in direct contact with the adjacent membrane in a zero-gap configuration. A cation permeable fluoropolymer based membrane, sold under the tradename Nafion ®117 by the E.I. dupont de Nemours & Company, separated the anode chamber from the cathode chamber. During cell operation, an aqueous solution of hypochlorous acid containing 25% by weight of HOCl was continuously fed to the anode chamber as the anolyte at a flow rate of about 0.5 ml/min.

The catholyte chamber was initially filled with deionized water. The deionized water was gradually acidified to a dilute hydrochloric acid of about 3% to about 5% concentration from the diffusion of a small amount of hypochlorous acid and/or chlorine gas from the anolyte chamber through the membrane. Since some water is also transported through the membrane with H+ions from the anolyte chamber to the catholyte chamber, excess catholyte is generated that was removed from the catholyte chamber by the rising action of the hydrogen and small amount of chlorine gas exiting out the top of the cathode into a catholyte gas-liquid disengager. The water transporting through the membrane obviates the need for adding further deionized water to the catholyte chamber after the initial fill.

After the initial startup, the cell was operated at a current of 7.5 amps which was gradually increased to a final current of 10 amps. The cell voltage was in the range of from 2.975 to 3.340 volts. Under these operating conditions, the combined concentration of chloric and perchloric acid in the catholyte increased to 22.691% by weight and the HOCl concentration decreased to 0.799% by weight. The concentration was determined by pH titration for strong acids. Gases produced in the anolyte chamber were scrubbed in an aqueous solution of 10% potassium iodide. The cell was operated for about twenty hours. The product was later analyzed using an iodimetric titration specific for chlorate and found that significantly less than the 22.691% by weight was not chloric acid. It was determined, therefore, that about 15% by weight was perchloric acid.

EXAMPLE 2

An electrochemical cell of the type shown in FIGS. 1 and 2 was employed having an anode chamber and a cathode chamber separated by a cation exchange membrane. No coolant was employed in the cooling plates. The anode was about 5.0 cm by about 5.0 cm and formed from a platinum-coated titanium felt made from ribbons averaging about 6 mils thick. The platinum coating was electroplated. The felt had about 90% porosity and electrolyte flowed from the back of the bottom of the anode chamber to the top. The anode chamber was defined by a flat plate of platinum-clad niobium metal at the rear and a membrane that separated the anode chamber from the cathode chamber. The platinum-coated titanium felt substantially filled the entire anode chamber. The cation exchange membrane was squeezed between the anode felt and the cathode surface. The anolyte was force circulated through the membrane. The cathode was formed from a two layer Hastelloy ®C-22 mesh structure having a very fine outer 60 mesh screen layer supported on a coarse inner (6 wires per inch) mesh layer. The cathode was attached to a solid Hastelloy ®C-22 backplate by spot welding. The backplate defined the rear of the cathode chamber. The cathode was in direct contact with the adjacent membrane in a zero-gap configuration. A cation permeable fluoropolymer based membrane, sold under the tradename Nafion ®117 by the E.I. dupont de Nemours & Company, separated the anode chamber from the cathode chamber. During cell operation, an aqueous solution of hypochlorous acid containing about 22% by weight of HOCl and about 0.35% by weight of $HClO_3$ was continuously fed to the anode chamber as the anolyte at a flow rate of about 1 gram/minute. The cell was operated at a current of about 8.7 amperes.

The anolyte solution was continuously recirculated through the cell at a rate of about 1000 milliliters per minute via a small recirculation loop. About ⅛ inch tubing was used to connect the inlet and outlet of the cell to the circulating pump. The product perchloric acid was continuously removed from the cell.

The catholyte chamber was initially filled with deionized water. The deionized water was gradually acidified to a dilute hydrochloric acid of about 3% to about 5% concentration from the diffusion of a small amount of hypochlorous acid and/or chlorine gas from the anolyte chamber through the membrane. Since some water was also transported through the membrane with H+ ions from the anolyte chamber to the catholyte chamber, excess catholyte was generated that was removed from the catholyte chamber by the rising action of the hydrogen and the small amount of chlorine gas exiting out the top of the cathode into a catholyte gas-liquid disengager. The water transporting through the membrane obviated the need for adding further deionized water to the catholyte chamber after the initial fill.

Gas leaving both the anolyte and the catholyte was collected during the run and passed through a solution containing about 10% potassium iodide to determine the amount of chlorine that had exited the cell.

After the initial startup, the cell was operated at a current which was gradually increased to a final current of about 20 amps and a current density of about 40 $KA/m^2$. The cell voltage was in the range of from about 3.00 to about 3.30 volts.

The cell was operated for eight hours, during which time the anolyte showed an early increase in chloric acid concentration and then a decrease in chloric acid concentration followed by an increase in perchloric acid concentration. The process achieved a steady state operation during the final two hours of the run with about 40% perchloric acid yield and a steady state current efficiency of about 40%. The perchloric acid yield was based on the moles of perchloric acid made per moles of HOCl fed. By the end of the eight hour run, only a trace amount of about 0.3% by weight chloric acid was present, despite about a 1.4% by weight level of excess HOCl left unconverted. The concentration of the perchloric acid based on titration was about 21%.

Product analysis was performed by two methods; a pH titration to calculate both total strong acid ($HClO_3$ and $HClO_4$) and total weak acid (HOCl) and ion chromatography. The pH titration was considered a reliable indication of total chloric and perchloric acids because of the complete absence of cations, other than hydrogen, in the feed to the process. The ion chromatographic analysis of neutralized and diluted product revealed separated peaks for chlorate and perchlorate. All three components (strong acid, weak acid and neutralized and diluted product) were determined separately by comparing the results of both methods.

Additionally, iodimetric analysis was performed on the cell feed to determine the hypochlorous acid control more accurately.

The scope of the appended claims is intended to encompass all obvious changes in the details, materials, and arrangement of parts that will occur to one of ordinary skill in the art upon a reading of the disclosure.

What is claimed is:

1. A method of operating a filter press membrane cell having an anloyte compartment and a catholyte compartment separated by a cation selectively permeable membrane comprising the steps of:

(a) continuously circulating and recirculating an anolyte solution containing aqueous hypochlorous acid substantially free of ionic impurities including chloride ions and alkali metal ions into and through the anolyte compartment;

(b) filling the catholyte compartment with a catholyte liquid; and (c) electrolyzing the anolyte solution to oxidize hypochlorous acid and cause $H_3O^+$ to migrate through the membrane producing an acidic catholyte and to produce chloric acid in the anolyte, the chloric acid further being electrochemically oxidized to form perchloric acid in the anolyte product where no oxygen is generated.

2. The method according to claim 1 further comprisign using deionized water as the catholyte and removing the acidified catholyte as hydrochloric acid from the catholyte compartment by the action of rising hydrogen gas bubbles.

3. The method according to claim 2 wherein the anolyte is recirculated through the cell at a rate of from about 500 to about 1500 milliliters per minute.

4. The method according to claim 3 wherein the anolyte is recirculated through the cella t a rate of from about 800 to about 1200 milliliters per minute.

5. The method according to claim 1 further comprising concentrating tne perchloric acid by heating.

6. The method according to claim 5 further comprising adding hydrochloric acid to the perchloric acid either before or during the heating.

7. The method according to claim 1 wherein the concentration of hypochlorous acid in the anolyte is initially greater than about 3 percent by weight.

8. The method according to claim 7 wherein the concentration of hypochlorous acid in the anolyte is initially greater than about 10 percent by weight.

9. The method according to claim 7 wherein the current density of the filter press membrane cell is greater than about 0.1 amp per square centimeter.

10. The method according to claim 9 wherein the concentration of hypochlorous acid in the anolyte after oxidizing the anolyte to form perchloric acid is less than about 3 percent by weight.

11. A process for the production of perchloric acid in an electrolytic cell divided by a cation selectively permeable membrane comprising the steps of:

(a) electrochemically oxidizing an electrolyte containing hypochlorous acid substantially free of ionic impurities including chloride ions and alkali metal ions to form chloric acid, and (b) electrochemically oxidizing the chloric acid further within the cell to form perchloric acid where no oxygen is generated.

12. The process according to claim 11 comprising using the hypochlorous acid in the anolyte.

13. The process according to claim 12 further comprising continuously recirculating the anolyte.

14. The process according to claim 13 further comprising initially using an anolyte with a hypochlorous acid concentration greater than about 3 percent by weight.

15. The process according to claim 14 further comprising electrochemically oxidizing the anolyte so that the hypochlorous acic concentration is less than about 3 percent by weight.

16. The process according to claim 14 wherein the hypochlorous acid concenrration in the anolyte is initially greater than about 10 percent by weight.

17. The process according to claim 16 wherein the hypochlorous acid concentration in the anolyte is initially greater than about 20 percent by weight.

18. The process according to claim 14 wherein the current density during the electrochemical oxidation is greater than about 0.1 amp per square centimeter.

19. The process according to claim 18 further comprising using an ion selectively permeable membrane in the cell to separate the anolyte from a catholyte.

* * * * *